US011171438B2

(12) United States Patent
Eagleton

(10) Patent No.: US 11,171,438 B2
(45) Date of Patent: Nov. 9, 2021

(54) UNITIZED CABLE PLUG ARRAY FOR MOBILE POWER GENERATION EQUIPMENT

(71) Applicant: Energy Services LLC, Glastonbury, CT (US)

(72) Inventor: Sean T. Eagleton, Poughkeepsie, NY (US)

(73) Assignee: Energy Services LLC, Glastonbury, CT (US)

( * ) Notice: Subject to any disclaimer, the term of this patent is extended or adjusted under 35 U.S.C. 154(b) by 0 days.

(21) Appl. No.: 16/844,377

(22) Filed: Apr. 9, 2020

(65) Prior Publication Data

US 2021/0320451 A1 Oct. 14, 2021

(51) Int. Cl.

| | |
|---|---|
| ***H01R 13/64*** | (2006.01) |
| ***H01R 13/502*** | (2006.01) |
| ***H01R 13/629*** | (2006.01) |
| ***H01R 13/631*** | (2006.01) |
| ***H01R 13/426*** | (2006.01) |

(52) U.S. Cl.

CPC ..... *H01R 13/5025* (2013.01); *H01R 13/426* (2013.01); *H01R 13/62955* (2013.01); *H01R 13/631* (2013.01)

(58) Field of Classification Search

CPC ..... H01R 13/426; H01R 13/5025; H01R 13/62955; H01R 13/631

USPC ..... 439/248

See application file for complete search history.

(56) References Cited

U.S. PATENT DOCUMENTS

| | | | | | |
|---|---|---|---|---|---|
| 1,745,233 | A * | 1/1930 | Schutt | H01R 13/631 | 439/381 |
| 2,398,634 | A * | 4/1946 | Geers | H01R 13/631 | 439/699.1 |
| 2,489,741 | A * | 11/1949 | Bonham | H01R 13/631 | 439/347 |
| 3,445,804 | A * | 5/1969 | Perkins | H01R 13/631 | 439/247 |
| 3,453,443 | A * | 7/1969 | Stoeckly | F02C 6/02 | 290/2 |
| 3,617,985 | A * | 11/1971 | Kehl | H01R 13/701 | 439/341 |
| 3,668,605 | A * | 6/1972 | Albert | H01R 13/62933 | 439/341 |

(Continued)

*Primary Examiner* — Abdullah A Riyami
*Assistant Examiner* — Vladimir Imas
(74) *Attorney, Agent, or Firm* — Schwegman Lundberg & Woessner, P.A.

(57) ABSTRACT

A system for coupling plugs and receptacles comprises a deformable base extending along an axis from a first end, through a middle portion and to a second end along a non-linear path, first connectors mounted to the base at different axial positions, a housing extending linearly from a third end to a fourth end, second connectors located on the housing at different linear positions, and a closure mechanism configured to deform the base such that each connector of the first connectors aligns with and is couplable to a corresponding connector of the second connectors. A method for coupling plugs and sockets comprises coupling a first plug extending from a base to a first socket located in a housing, aligning a second plug extending from the base with a second socket located in the housing, and flexing the base to bring the second plug into engagement with the second socket.

18 Claims, 4 Drawing Sheets

(56) References Cited

U.S. PATENT DOCUMENTS 3,692,966 A * 9/1972 Lancaster ..... H01R 24/60 200/51.1
4,140,918 A * 2/1979 Lancaster ..... H01R 24/58 307/112
4,256,936 A * 3/1981 Lancaster ..... H01R 13/582 200/51.07
4,361,955 A * 12/1982 Lancaster ..... H01R 13/582 29/874
4,363,531 A * 12/1982 Lancaster ..... H01R 13/582 439/465
4,550,971 A * 11/1985 Gentric ..... H01R 13/501 439/404
4,981,438 A * 1/1991 Bekhiet ..... H02B 1/202 439/502
4,998,884 A * 3/1991 Ishikawa ..... H01R 43/26 439/49
5,007,858 A * 4/1991 Daly ..... H01R 23/661 439/498
5,044,999 A * 9/1991 Brandeau ..... H01R 12/613 439/879
5,199,892 A * 4/1993 Campbell ..... H01R 13/631 361/787
5,266,042 A * 11/1993 Hampel ..... H01R 24/58 439/188
5,302,136 A * 4/1994 St. Germain ..... H01R 13/631 439/341
5,411,402 A * 5/1995 Bethurum ..... G06K 19/07743 29/857
5,538,437 A * 7/1996 Bates, III ..... H01R 13/6275 439/352
RE35,508 E * 5/1997 Lemke ..... H01R 12/716 439/101
5,735,702 A * 4/1998 Hio ..... H01R 13/516 439/157
5,941,729 A * 8/1999 Sri-Jayantha ..... H01R 13/6392 439/505
6,146,180 A * 11/2000 Betker ..... H01R 13/6273 439/350
6,280,241 B2 * 8/2001 Herlinger ..... H01R 12/592 439/496
6,811,416 B2 * 11/2004 Yano ..... H01R 9/2625 439/152
7,303,420 B2 * 12/2007 Huch ..... H01R 13/635 439/341
7,722,377 B2 * 5/2010 Moore ..... H01R 13/6392 439/341
7,896,683 B1 * 3/2011 Ratzlaff ..... H01R 13/631 439/374
8,231,637 B2 * 7/2012 Greenberg ..... A61F 9/08 606/129
8,485,838 B2 * 7/2013 Kataoka ..... H01R 13/5208 439/271
9,017,087 B1 * 4/2015 Rossman ..... H01R 13/73 439/248
9,065,195 B2 * 6/2015 Wallner ..... H01R 13/501
9,112,318 B2 * 8/2015 Cech ..... H05K 7/1469
9,263,818 B2 * 2/2016 Lam ..... H01R 13/631
9,287,666 B2 * 3/2016 Walters ..... H01R 12/7005
9,331,440 B2 * 5/2016 Yoshida ..... H01R 24/60
9,532,479 B2 * 12/2016 Hamada ..... H05K 7/1468
9,640,908 B2 * 5/2017 Mizrahi ..... H01R 13/6315
9,896,920 B2 * 2/2018 Holder ..... E21B 43/263
9,923,298 B2 * 3/2018 Hashimoto ..... H01R 13/5025
9,954,314 B2 * 4/2018 Mozer ..... H01R 13/62905
9,985,369 B1 * 5/2018 Lu ..... H01R 12/716
10,060,349 B2 8/2018 Morales Álvarez et al.
10,283,896 B1 * 5/2019 Hennon ..... H01R 13/052
10,404,003 B2 * 9/2019 Dendas ..... H01R 12/714
10,737,267 B2 * 8/2020 Kilcoin ..... F04B 23/025
10,895,202 B1 * 1/2021 Yeung ..... E21B 43/2607
2009/0117786 A1 * 5/2009 Westkamp ..... H01R 13/631 439/676
2012/0040544 A1 * 2/2012 Egloff ..... H01R 13/635 439/152
2016/0079704 A1 * 3/2016 Chen ..... H01R 13/631 439/374
2020/0052438 A1 * 2/2020 Sobel ..... H01R 13/426
2020/0176919 A1 * 6/2020 DeWitt ..... H01R 13/512

* cited by examiner

UNITIZED CABLE PLUG ARRAY FOR MOBILE POWER GENERATION EQUIPMENT

TECHNICAL FIELD

This document pertains generally, but not by way of limitation, to power generation equipment, such as mobile power generation equipment. More specifically, but not by way of limitation, the present application relates to connectors used to couple various cables used in power generation equipment.

BACKGROUND

Power generation equipment may include numerous support and control components interconnected with various cables. These cables may transfer large amounts of power as well control input and output signals. Various electro-mechanical cable devices are used to ensure proper connection at each cable-connector interface. Some of these devices are intended to provide protective shielding from the high power they transmit, while others may be intended to provide protective shielding to the data that they transfer.

Examples of mobile power generation equipment are described in U.S. Pat. No. 10,060,349 to Morales Alverez et al.

OVERVIEW

Problems to be solved in operating mobile power generation equipment include disconnecting and reconnecting cables such that the mobile power generation equipment can be disassembled, transported to a new location and set up for operation. In order to transport mobile power generation equipment, the various cable connectors must each be disconnected, and then reconnected when the mobile power generation equipment is re-located. The disconnection and re-connection of each cable connector may take time and delay an ability for mobile power generation equipment to initiate operation upon arrival at its new location. Ensuring that each cable, of what can be a plurality of very similar cables, is connected to the proper receptacle at each end may consume additional time.

The present inventor has recognized that, in some configurations, cable-connectors can be grouped together for simultaneous coupling. The present inventor has further recognized that simultaneous coupling of multiple cable-connectors becomes increasingly difficult the greater the number of cable-connectors that are being coupled. For example, it becomes more difficult to ensure proper alignment of a large number of cable-connectors. Likewise, the force required to connect a large number of cable-connectors can grow considerably, such as beyond levels that can be easily achieved with manual labor. The present inventor has recognized that such problems can be mitigated by providing a unitized cable plug array that stages coupling of multiple cable-connectors. Each incremental coupling of one plug (or a sub-set of the total amount of plugs) with one receptacle (or a sub-set of the total amount of receptacles) further aligns the array making additional cable-connector couplings easier. Furthermore, each incremental coupling of one plug (or a sub-set of the total amount of plugs) with one receptacle (or a sub-set of the total amount of receptacles) staggers or spaces out the force required to connect the entire cable-connector array such that only one (or a sub-set of the total number of cable-connectors) needs to be coupled together at one time.

In an example, a cable plug array for a mobile power generation system can comprise a plug component comprising a base extending along a curved axis from a first end, through a middle portion and to a second end, wherein the base is configured to be curved such that the middle portion extends beyond the first and second ends in a relaxed state and to be straight such that the middle is aligned with the first and second ends in a deflected state and a plurality plugs extending from the base, and a receptacle component comprising a housing extending along a straight axis from a third end to a fourth end and a plurality of receptacles positioned along the housing, wherein the plug component and the receptacle component are configured to be brought together such that a first plug of the plurality of plugs located at the middle portion is configured to engage a first receptacle of the plurality of receptacles when the base is in the relaxed state and a second of the plurality of plugs located proximate the first or second end of the base is configured to engage a second of the plurality of receptacles as the base is flexed into the deflected state with the first plug engaged with the first receptacle.

In another example, a method for coupling an array of plugs and sockets that form a plurality of independent circuits can comprise coupling a first plug extending from a base to a first socket located in a housing, aligning a second plug extending from the base with a second socket located in the housing, and flexing the base to bring the second plug into engagement with the second socket.

In an additional example, a system for coupling an array of plugs and receptacles that form a plurality of independent circuits can comprise a deformable base extending along an axis from a first end, through a middle portion and to a second end along a non-linear path, a plurality of first connectors mounted to the base at different axial positions, a housing extending linearly from a third end to a fourth end, a plurality of second connectors located on the housing at different linear positions, and a closure mechanism configured to deform the base such that each connector of the plurality of first connectors aligns with and is couplable to a corresponding connector of the plurality of second connectors.

This overview is intended to provide an overview of subject matter of the present patent application. It is not intended to provide an exclusive or exhaustive explanation of the invention. The detailed description is included to provide further information about the present patent application.

Figure 1:
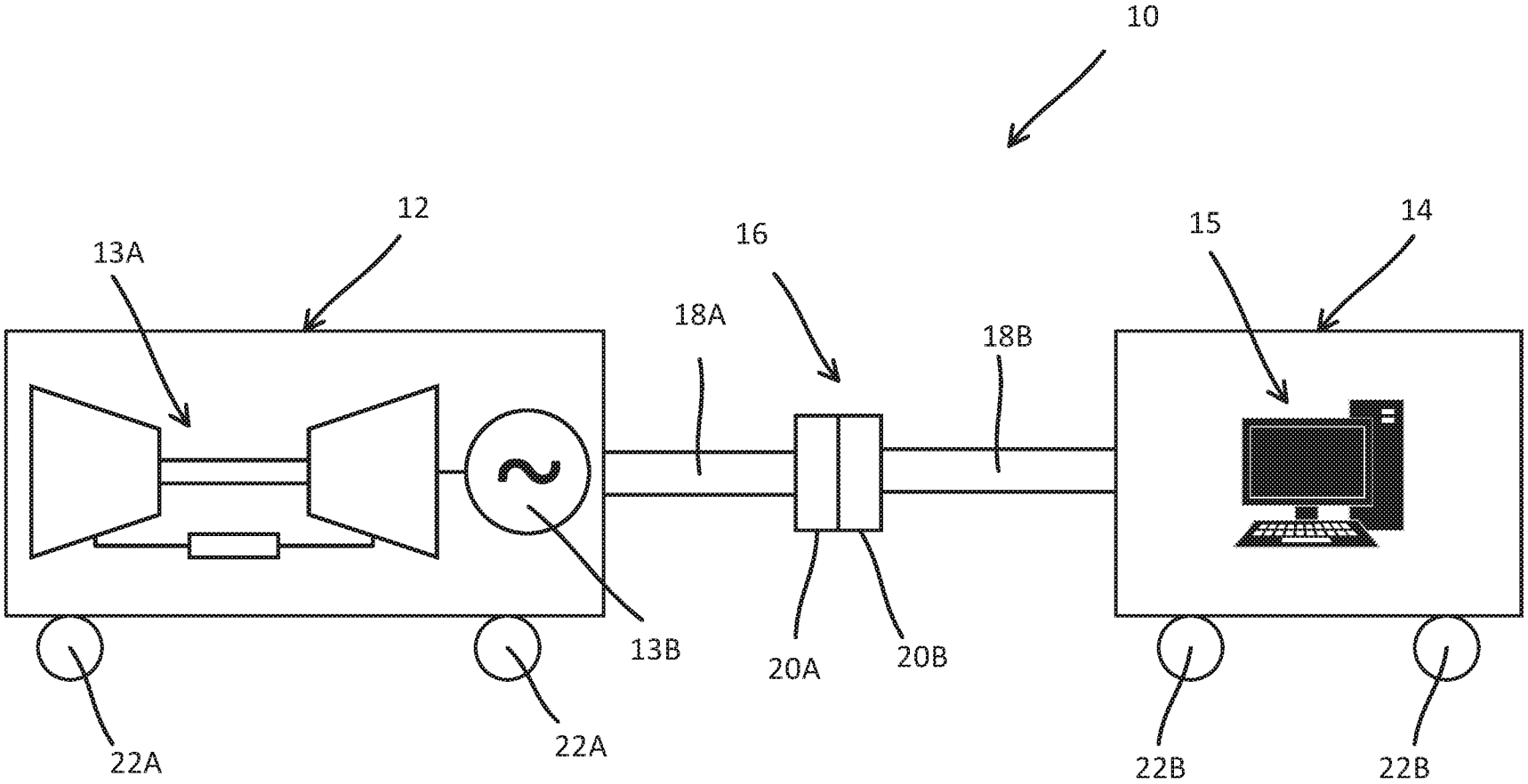
FIG. 1 is a schematic diagram of a mobile power generation system comprising a power generation unit and a control room.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

FIG. 1 is a schematic diagram of mobile power generation system 10 comprising power generation unit 12, including gas turbine engine 13A and electric generator 13B, and control room 14, including computer 15. Power generation unit 12 and control room 14 can be connected via unitized cable plug array 16. Unitized cable plug array 16 can comprise cable bundles 18A and 18B that connect power generation unit 12 and control room 14, respectively, with unitized cable plug array 16. Unitized cable plug array 16 can comprise base 20A and housing 20B. Power generation unit 12 can include mobility units 22A and control room 14 can include mobility units 22B.

Gas turbine engine 13A can be configured to combust a fuel to provide rotational input to electrical generator 13B, thereby providing electrical power that can be made available for use by consumers external to system 10. Control room 14 can include computer 15 for controlling gas turbine engine 13A and electrical generator 13B. Computer 15 can include various hardware, such as processors, memory, circuitry and the like, and software, e.g., computer-implemented instructions stored or embedded in various memory devices such as non-transitory computer storage mediums. Mobile power generation system 10 can be moved to different locations to provide electrical power to different localities. Mobility units 20A and 20B can comprise wheels, tracks and the like and can be self-motive. In other examples, power generation unit 12 and control room 14 can be jointly or individually coupled to a vehicle such as by using a trailer hitch, etc. In yet other examples, power generation unit 12 and control room 14 can be configured for loading into or onto other transportation units, such as trailers and shipping containers. In order to transport system 10, control room 14 and power generation unit 12 can be separated for separate transportation to the various localities. As such, unitized cable plug array 16 can be used to facilitate coupling of cable bundles 18A and 18B for power generation unit 12 and control room 14. Cable bundles 18A and 18B can each include a plurality of conductors or strands that are configured as individual, insulated circuits. Each of these circuits can be configured to connect a particular portion of control room 14 with a particular portion of power generation unit 12. As such, many different cables can require coupling to ensure proper operation of mobile power generation system 10. Unitized cable plug array 16 can be disconnected to facilitate transportation and can be reconnected to facilitate set-up. As discussed herein, unitized cable plug array 16 can facilitate rapid coupling and uncoupling of cable bundles 18A and 18B, thereby avoiding the need to have to individually connect and disconnect a plurality of separate plugs and receptacles.

Figure 2:
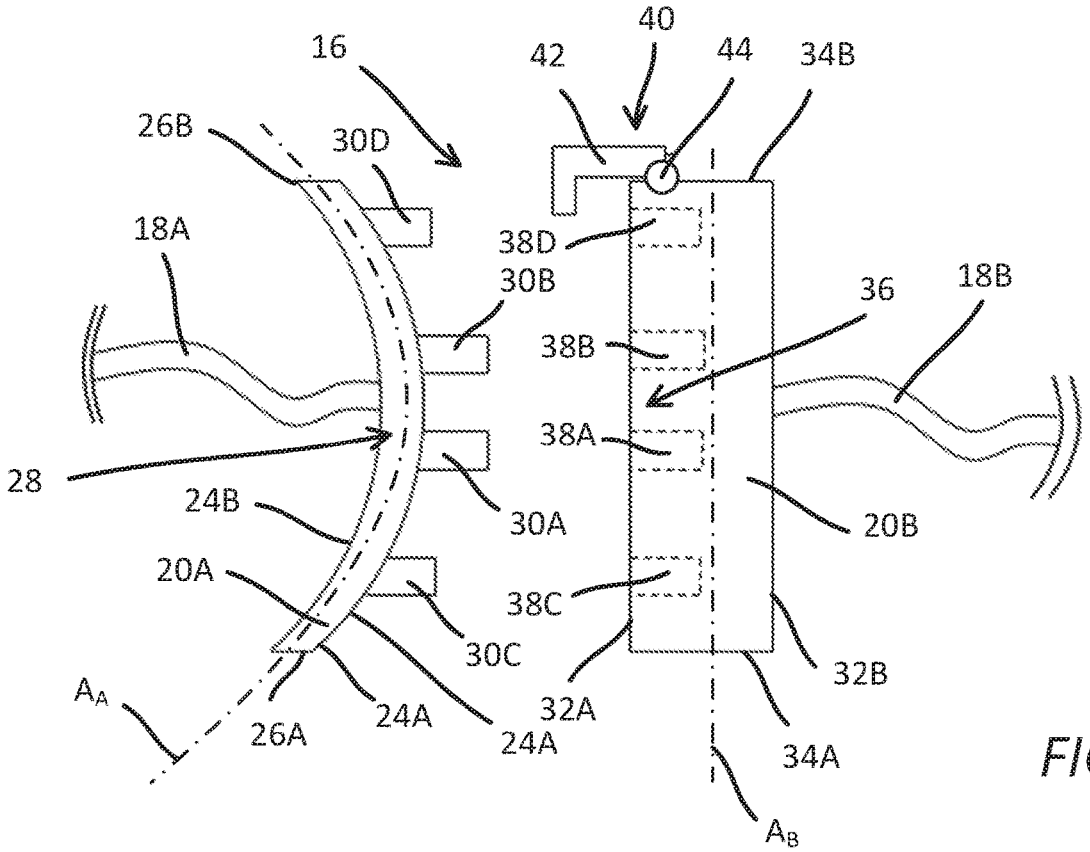
FIG. 2 is a schematic side view of a unitized cable plug array comprising a plug base and a receptacle housing.
Figure 3:
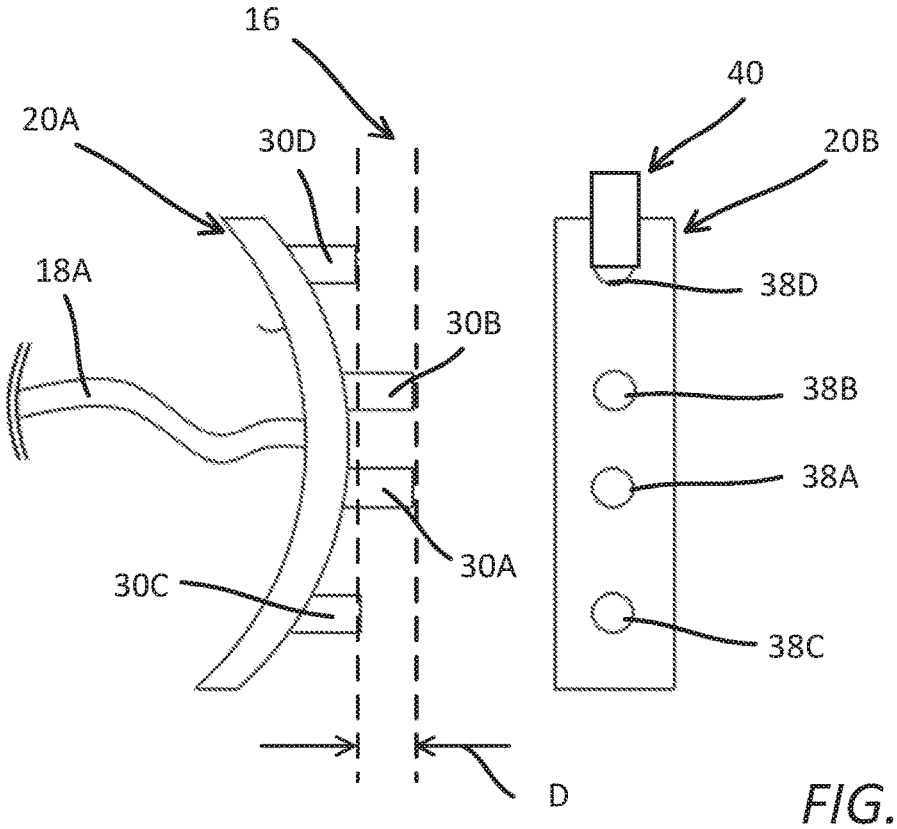
FIG. 3 is a schematic side view of the plug base and a schematic front view of the receptacle housing.

FIG. 2 is a schematic side view of unitized cable plug array 16 comprising plug base 20A and receptacle housing 20B. FIG. 3 is a schematic side view of plug base 20A and front view of receptacle housing 20B. FIGS. 2 and 3 are discussed concurrently. Plug base 20A can comprise engagement side 24A, back side 24B, first side 26A, second side 26B, middle portion 28 and plugs 30A, 30B, 30C and 30D. Receptacle housing 20B can comprise engagement side 32A, back side 32B, first side 34A, second side 34B, middle portion 36 and receptacles 38A, 38B. 38C and 38D. Unitized plug array 16 can further comprise retention device 40, which can be located on plug base 20A or receptacle housing 20B. In the illustrated example, retention device 40 comprises hook mechanism 42 attached to receptacle housing 20 via hinge mechanism 44.

Plugs 30A-30D can each comprise a cartridge having terminals with ends of one or more conductors. Receptacles 38A-38D can each comprise a socket having terminals with ends of one or more conductors configured to couple with the terminals in plugs 30A-30D. As such, specific electrical locations in control room 14 can be connected to specific electrical locations in power generation unit 12. The conductors can be configured to go to different locations on each of control room 14 and power generation unit 12 such that each conductor can be an individually insulated circuit. As such, unitized cable plug array 16 can comprise an array of individual plugs and receptacles that provide separate electrical functionality, but are coupled together in a common harness.

Plug base 20A can extend along axis $A_A$ that extends through the center (or thereabouts) of plug base 20A from first side 26A, through middle portion 28 and to second side 26B. Axis $A_A$ can extend in a non-linear geometry. In the illustrated example, axis $A_A$ extends in an arcuate manner such that middle portion 28 projects to the front of plug base 20A while first side 26A and second side 26B project toward cable bundle 18A to the rear of plug base 20A. As such, plug base 20A comprises a geometry such the engagement side 24A, or front side, and middle portion 28 can be longitudinally displaced from first side 26A and second side 26B.

Receptacle housing 20B can extend along axis $A_B$ that extends through the center (or thereabouts) of receptacle housing 20B from first side 34A, through middle portion 36 and to second side 34B. Axis $A_B$ can extend in a linear geometry such that middle portion 36 is longitudinally aligned with first side 34A and second side 34B.

In the illustrated example, unitized cable plug array 16 comprises four plugs and receptacles. However, unitized cable plug array 16 can be configured with any number of plug and receptacle combinations. Additionally, unitized cable plug array 16 is illustrated as having plugs 30A-30D and receptacles 38A-38D being spaced along plug base 20A and receptacle housing 20B in a generally uniform pattern, with two plugs 30B and 30D and receptacles 38B and 30D above and two plugs 30A and 30C and receptacles 38A and 38C below cable bundles 18A and 18B, respectively. However, other patterns, uniform or non-uniform (e.g., irregular) can be used.

Receptacles 38A-38D can extend into engagement side 32A in co-linear or parallel manners such that center axes for each of receptacles 38A-38D is perpendicular to axis $A_B$. Plugs 30A-30D can extend or project from engagement side 24A in co-linear or parallel manners such that center axes for each of plugs 30A-30D are also perpendicular to axis $A_B$, thereby making each of plugs 30A-30D extend at an angle relative to axis $A_A$.

As can be seen in FIG. 2, plug base 20A is curved such that tips of plugs 30C and 30D are located approximately at or below bases of plugs 30A and 30B. As such, there is a distance D between tips of plugs 30A and 30B and tips of plugs 30C and 30D. As such, plugs 30A and 30B can be fully, or nearly fully, inserted into receptacles 38A and 38B, respectively, without plugs 30C and 30D engaging (or just beginning to engage) receptacles 38C and 38D, respectively. Thus, as discussed below, the force require to coupled plug base 20A and receptacle housing 20B is equal to only the force required to join plugs 30A and 30B with receptacles 38A and 38B and the additional force that would be needed to join plugs 30C and 30D with receptacles 38C and 38D is delayed or staged until after plugs 30A and 30B are nearly fully seated.

As discussed in greater detail below with reference to FIGS. 4 and 5, plug base 20A can be deformed, flexed or bent to allow plugs 30C and 30D to engage receptacles 38C and 38D. Engagement of plugs 30C and 30D with receptacles 38C and 38D can be facilitated by the previously existing engagement of plugs 30A and 30B with receptacles 38A and 38B, respectively. For example, the paired nature of plugs 30A and 30B being spaced apart along a distance proximate middle portion 28 provides rotational alignment of plug base 20A with receptacle housing 20B. In other examples, only a single plug can be located at middle portion 28 with a mating single receptacle being located at middle portion 36. In such configurations, plug base 20A and receptacle housing 20B can be manually aligned to align other plugs with their corresponding receptacles.

Figure 4:
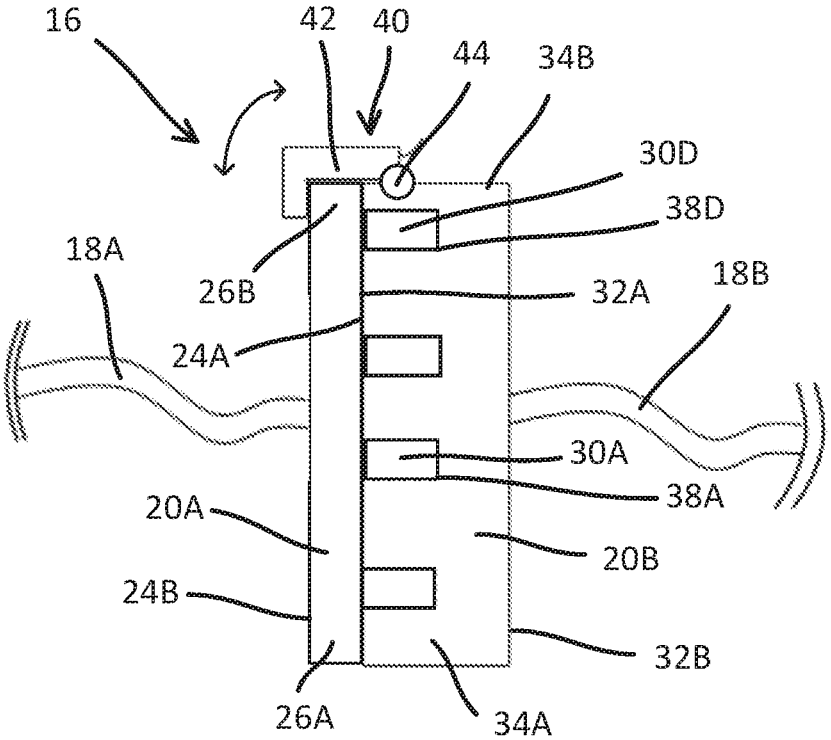
FIG. 4 is a schematic side view of the unitized cable plug array of FIG. 2 with the plug base being held in engagement with the receptacle housing by a retention device.

FIG. 4 is a schematic side view of unitized cable plug array 16 of FIG. 2 with plug base 20A being held in engagement with receptacle housing 20B by retention device 40. Hook mechanism 42 can be mounted on hinge mechanism 44 to allow hook mechanism 42 to rotate toward and away from second side 34B. As such, before plug base 20A is brought into contact with receptacle housing 20B, hook mechanism 42 can be rotated upward to allow plug 20A to engage receptacle housing 20B unhindered.

Initially, plug base 20A can be brought into engagement with receptacle housing 20B such that plugs 30A and 30B engage receptacles 38A and 38B. Due to the curvature of plug base 20A, plugs 30C and 30D will not engage, or at least not fully engage, receptacles 38C and 38D. As mentioned, plug base 20B can be made of a deformable or resilient material that can be bent or flexed such that axis $A_A$ conforms to the shape of axis $A_B$. With respect to the illustrated example, plug base 20A can be bent such that the curvature of axis $A_A$ is flattened out to be parallel to axis $A_B$. In examples, plug base 20B can be made of rubber or plastic material. In examples, receptacle housing 20B can be made of a material that is relatively stiffer than that of plug base 20A, such as metal or a plastic. As such, receptacle housing 20B can be resistive to forces from plug base 20A when plug base 20A is being deformed to engage plugs 30C and 30D with receptacles 38C and 38D.

Plug base 20A can be bent such that first side 26A is brought into engagement with first side 34A of receptacle housing 20B and second side 26B is brought into engagement with second side 34B of receptacle housing 20B. As such, plugs 30C and 30D can be inserted into receptacles 38C and 38D. With receptacles 38C and 38D holding plugs 30C and 30D, middle portion 28 of plug base 20A can be biased toward middle portion 36 of receptacle housing 20B due to the resiliency of plug base 20A.

In examples, the resiliency of plug base 20A can be variable across axis $A_A$. For example, the illustrated example shows only a single plug outward of plugs 30A and 30B in each longitudinal direction. However, additional plugs 30 can be provided longitudinally outward of plugs 30C and 30D on portions of plug base 20A that are curved to be behind (e.g., further to the left in FIG. 4) first side 26A and second side 26B. In such examples, plug base 20A can be configured to be decreasingly stiff in the radially outward directions such that the force required to further bend plug base 20A does not compound the longer plug base 20A becomes and the more plugs are provided. In additional examples, the curvature of plug base 20A can be varied along axis $A_A$ to provide differing bending or packaging characteristics.

With reference to the configuration of FIG. 4, after plugs 30C and 30D are seated in receptacles 38C and 38D, retention device 40 can be operated to retain plug base 20A against receptacle housing 20B. For example, hinge mechanism 44 can be operated to rotate hook mechanism 42 down against second side 34B such that a portion of hook mechanism 42 overhangs back side 24B, thereby preventing plug base 20A from withdrawing from receptacle housing 20B. Retention device 40 can be provided on first side 34A alternatively or in addition to being on second side 34B. Additionally, one or more retention devices 40 can be provided on plug base 20A instead of on receptacle housing 20B. Furthermore, although the present disclosure is described with plug base 20A being curved and made of a resilient material, in additional examples receptacle housing 20B can be configured to conform to the shape (e.g., linear) of plug base 20A.

Figure 5:
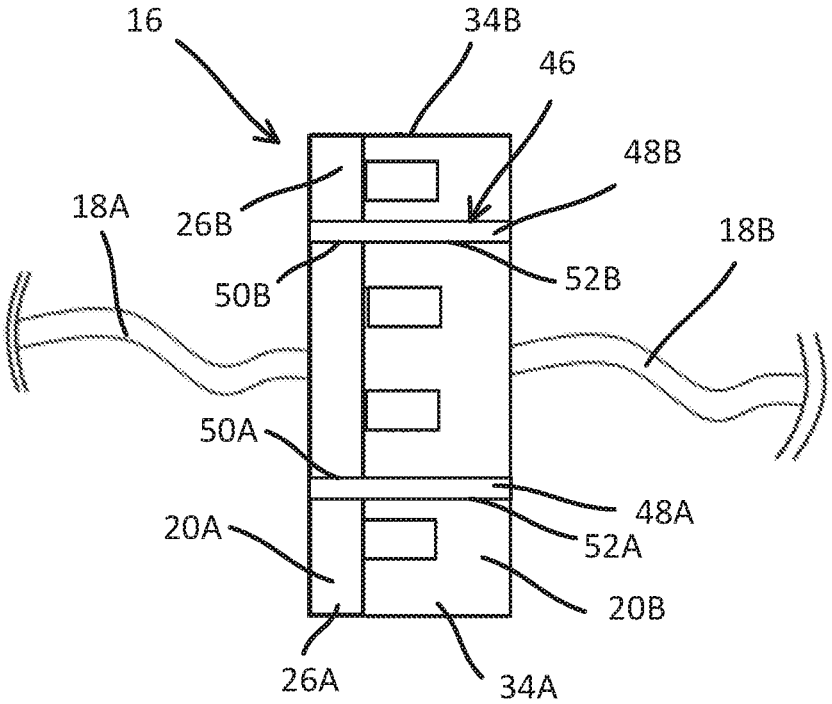
FIG. 5 is a schematic side view of the unitized cable plug array of FIG. 2 with the plug base being held in engagement with the receptacle housing by a drawing device.

FIG. 5 is a schematic side view of unitized cable plug array 16 of FIG. 2 with the plug base 20A being held in engagement with receptacle housing 20B by drawing device 46. Drawing device 46 can comprise first rod 48A and second rod 48B. In FIG. 5, unitized cable plug array 16 can be configured similarly as is described with reference to FIG. 4, with retention device 40 being omitted for clarity. Drawing device 46 can be provided as an alternative or an adjunct to retention device 40. Drawing device 46 can be provided as a device or system for bringing first side 26A and second side 26B of plug base 20A toward first side 34A and second side 34B of receptacle housing 20B, respectively. In the absence of drawing device 46, plug base 20A can be manually deformed, flexed or bent to complete the insertion of plugs 30C and 30D into receptacles 38C and 38D. However, drawing device 46 can provide a mechanical advantage for drawings first side 26A and second side 26B of plug base 20A toward first side 34A and second side 34B of receptacle housing 20B, respectively. In the illustrated example, drawing device 46 can comprise a pair of threaded rods 48A and 48B having first ends configured to rotate in sockets 50A and 50B in plug base 20A, respectively, and second ends threadedly engaged with threaded bores 52A and 52B in receptacle housing 20B, respectively. With unitized plug array 16 disassembled, rods 48A and 48B can be retained in sockets 50A and 50B and can extend therefrom. As plug base 20A is brought into engagement with receptacle housing 20B, distal ends of rods 48A and 48B can be placed into threaded bores 52A and 52B, respectively. Rods 48A and 48B can then be rotated within sockets 50A and 50B to engage the threading of threaded bores 52A and 52B. Continued rotation of rods 48A and 48B can pull rods 48A and 48B further into threaded bores 52A and 52B, thereby bringing first side 26A and second side 26B of plug base 20A toward first side 34A and second side 34B of receptacle housing 20B, respectively. Rods 48A and 48B can be manually rotated, such as with a hand or a wrench, or can be powered such as with a motor (not shown). Other types of drawing devices can be utilized, such as lever mechanism or pulley mechanisms.

Figure 6:
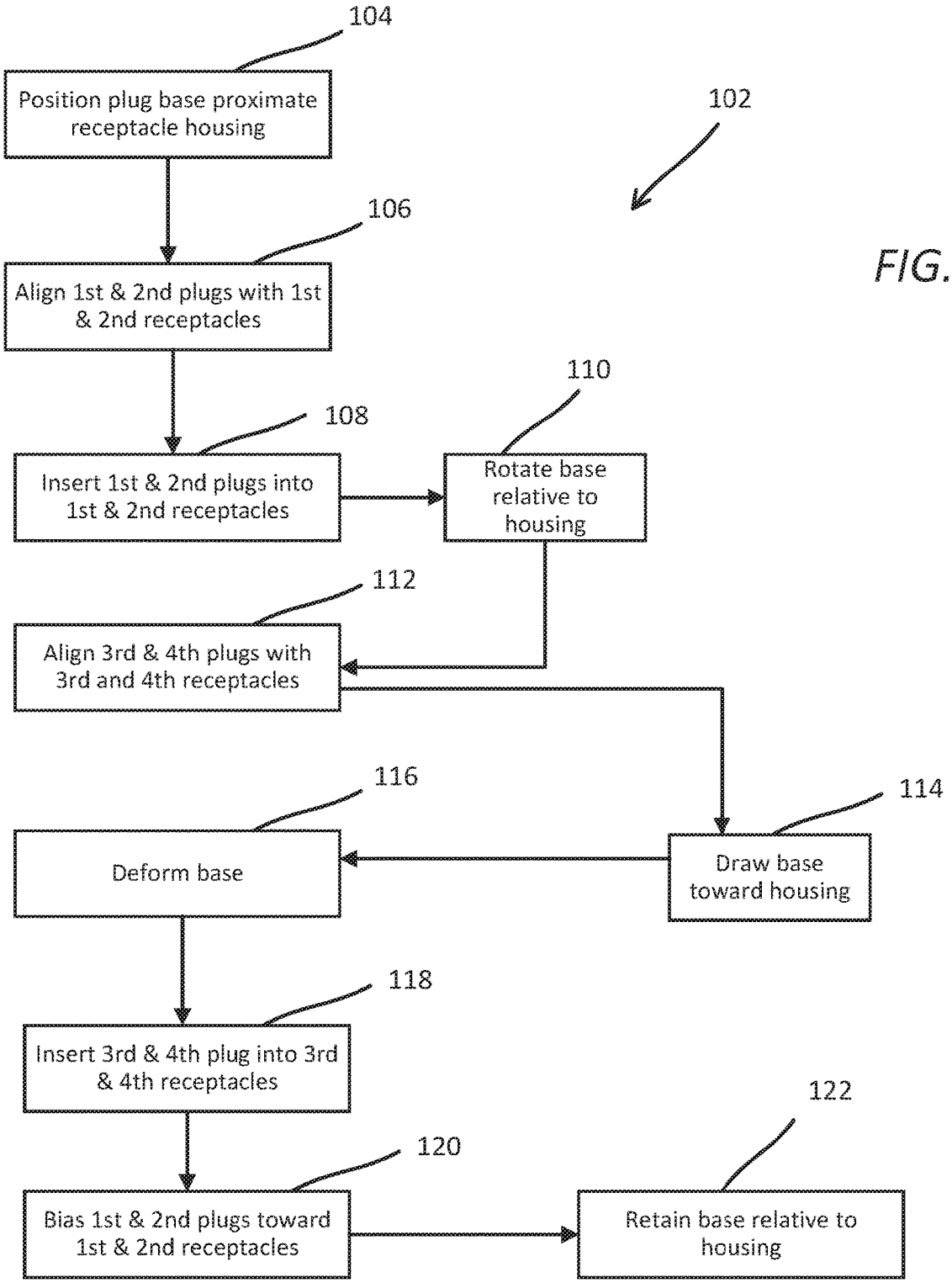
FIG. 6 is a line diagram illustrating a method for staging connection of a plurality of plugs with a plurality of receptacles using unitized cable plug arrays of the present disclosure.

FIG. 6 is a line diagram illustrating method 102 for staging connection of a plurality of plugs 30A-30D with a plurality of receptacles 38A-38D using unitized cable plug arrays 16 of the present disclosure.

At step 104, plug base 20A can be positioned proximate receptacle housing 20B. In particular, middle portion 28 of plug base 20A can be positioned opposite middle portion 36 of receptacle housing 20B.

At step 106, first plug 30A can be aligned with first receptacle 38A such that a central axis of first plug 30A aligns with a central axis of first receptacle 38A. Additionally, second plug 30B can be aligned with second receptacle 38B such that a central axis of second plug 30B aligns with a central axis of second receptacle 38B.

At step 108, first plug 30A can be inserted into first receptacle 38A and second plug 30B can be inserted into second receptacle 38B. Plug base 20A can be advanced toward receptacle housing 20B such that first plug 30A is positioned within first receptacle 38A and second plug 30B is positioned within second receptacle 38B. First plug 30A and second plug 30B can be force fit into first receptacle 38A and second receptacle 38B such that an engagement force is overcome to fully seat first plug 30A within first receptacle 38A and second plug 30B within second receptacle 38B.

At step 110, plug base 20A can be adjusted relative to receptacle housing 20B such that a central axis of third plug 30C can align with a central axis of third receptacle 38C and a central axis of fourth plug 30D can align with a central axis of fourth receptacle 38D.

At step 112, receptacle housing 20B can be rotated relative to plug base 20A by engagement of plugs 30A and 30B with receptacles 38A and 38B to automatically align third and fourth plugs 30C and 30D with third and fourth receptacles 38C and 38D, respectively. First plug 30A and second plug 30B can be simultaneously inserted into first receptacle 38A and second receptacle 38B, which can cause plug base 20A to rotate relative to receptacle housing 20B to cause third plug 30C to align with third receptacle 38C and fourth plug 30D to align with fourth receptacle 38D. However, other ways of aligning third and fourth plugs 30C and 30D with third and fourth receptacles 38C and 38D can be used, such as manual adjustment measures, particularly when only a single plug and receptacle are located on middle portions 28 and 36.

At step 114, plug base 20B can be drawn toward receptacle housing 20B via drawing device 46 or another suitable means. Drawing device 46 can be automatically operated (e.g., powered) to bring plug base 20A into engagement with receptacle housing 20B.

At step 116, plug base 20A can be deformed, flexed or bent. In examples, plug base 20A can be manually deformed, flexed or bent by an operator to move first side 26A into engagement with first side 34A and to bring second side 26B into engagement with second side 34B.

At step 118, third plug 30C can be inserted into third receptacle 38C and fourth plug 30D can be inserted into fourth receptacle 38D.

At step 120, engagement of third plug 30C with third receptacle 38C and fourth plug 30D with fourth receptacle 38D can hold plug base 20A such that middle portion 28 is biased toward middle portion 36. In examples, third and fourth plugs 30C and 30D can be force fit into third and fourth receptacles 38C and 38D, respectively. In examples, the force fit for third and fourth plugs 30C and 30D can be greater than that of first and second plugs 30A and 30B to allow third and fourth plugs 30C and 30D to have holding power to overcome the resiliency of plug base 20A.

At step 122, plug base 20A can be retained against receptacle housing 20B. In examples, retention device 40 can be operated prevent unbiasing or undeforming of plug base 20A to the shape of FIGS. 2 and 3.

The implementation of the aforementioned devices, systems and methods can allow for either one or a combination of the following:

1. Improved overall set-up and take-down times for mobile power generation equipment;
2. Easier alignment of multiple cable-connectors;
3. Staggered or dispersed coupling forces;
4. Organization of multiple cable bundles;
5. Reduced operator fatigue in assembling or installing mobile power generation equipment; and
6. Allowing mobile power generation equipment to come on-line faster.

VARIOUS NOTES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B." "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A cable plug array for a mobile power generation system, the cable plug array comprising a plug component comprising:

a base extending along a curved axis from a first end, through a middle portion and to a second end, wherein the base is configured to be curved such that the middle portion extends beyond the first and second ends in a relaxed state and to be straight such that the middle is aligned with the first and second ends in a deflected state; and a plurality of plugs extending from the base; and a receptacle component comprising:

a housing extending along a straight axis from a third end to a fourth end; and a plurality of receptacles positioned along the housing;

wherein the plug component and the receptacle component are configured to be brought together such that a first plug of the plurality of plugs located at the middle portion is configured to engage a first receptacle of the plurality of receptacles when the base is in the relaxed state and a second of the plurality of plugs located proximate the first or second end of the base is configured to engage a second of the plurality of receptacles as the base is flexed into the deflected state with the first plug engaged with the first receptacle.

2. The cable plug array of claim 1, wherein:

each plug of the plurality of plugs comprises a plurality of conductors that are insulated from each other; and each receptacle of the plurality of receptacles comprises a plurality of contacts to engage the plurality of conductors on a respective plug.

3. The cable plug array of claim 2, wherein:

each plug and receptacle pairing forms an independent circuit; and the plug component and the receptacle component each includes a cable bundle for the independent circuits, the cable bundles being configured for coupling to power generation equipment.

4. The cable plug array of claim 1, wherein one of the base and the housing is coupled to a mobile power generation unit and the other of the base and the housing not coupled to the mobile power generation unit is coupled to a mobile control room.

5. The cable plug array of claim 1, wherein the first plug comprises one of a pair of plugs located in the middle portion and the first receptacle comprises one of a pair of receptacles such that engagement of the pair of plugs with the pair of receptacles aligns the second plug with the second receptacle.

6. The cable plug array of claim 1, wherein the base is fabricated from a resilient material.

7. The cable plug array of claim 1, further comprising a retention device configured to hold the base in the deformed state against the housing.

8. The cable plug array of claim 7, wherein the retention device comprises a hinged hook.

9. The cable plug array of claim 8, wherein the retention device is further configured to draw the base and housing toward each other.

10. The cable plug array of claim 9, wherein the retention device comprises a threaded rod configured to interface with a threaded bore.

11. The cable plug array of claim 1, wherein the curved axis is shaped such that a tip of the first plug extends beyond a tip of the second plug relative to a surface configured to engage the housing.

12. A method for coupling an array of plugs and sockets that form a plurality of independent circuits, the method comprising:

coupling a first plug extending from a base to a first socket located in a housing by inserting a first pair of plus into a first pair of sockets;

aligning a second plug extending from the base with a second socket located in the housing; and flexing the base to bring the second plug into engagement with the second socket by:

deflecting the base from a curved and relaxed state where the first plug is engaged with the first socked to a deflected and deformed state where the second plug is engaged with the second socket; and retaining the base in the deflected and deformed state with a retention mechanism.

13. The method of claim 12, wherein aligning the second plug extending from the base with the second socket located in the housing comprises rotating the base relative to the housing by aligning the first pair of plugs with the first pair of sockets.

14. The method of claim 12, further comprising biasing the first plug into the first socket by engagement of the second plug with the second socket.

15. The method of claim 12, further comprising drawing first and second ends of the base toward third and fourth ends of the housing to deform the base using the retention mechanism.

16. A system for coupling an array of plugs and receptacles that form a plurality of independent circuits, the system comprising:

a deformable base extending along an axis from a first end, through a middle portion and to a second end along a non-linear path;

a plurality of first connectors mounted to the base at different axial positions;

a housing extending linearly from a third end to a fourth end;

a plurality of second connectors located on the housing at different linear positions; and a closure mechanism configured to deform the base such that each connector of the plurality of first connectors aligns with and is couplable to a corresponding connector of the plurality of second connectors.

17. The system of claim 16, wherein:

the plurality of first connectors comprises plugs; and the plurality of second connectors comprises receptacles.

18. The system of claim 16, wherein the deformable base comprises: a body that is deflectable from a first relaxed state wherein the axis of the base extends along a curved path to a second deformed state wherein the axis of the base extends along a straight path.

* * * * *